US006224149B1

(12) United States Patent
Gevaert

(10) Patent No.: US 6,224,149 B1
(45) Date of Patent: May 1, 2001

(54) TABLET MOUNTING ASSEMBLY FOR A SEATING SYSTEM

(75) Inventor: Steven C. Gevaert, Green Bay, WI (US)

(73) Assignee: Krueger International, Inc., Green Bay, WI (US)

( * ) Notice: Subject to any disclaimer, the term of this patent is extended or adjusted under 35 U.S.C. 154(b) by 0 days.

(21) Appl. No.: 09/440,580

(22) Filed: Nov. 15, 1999

(51) Int. Cl.[7] ..... A47B 39/02
(52) U.S. Cl. ..... 297/162; 297/160
(58) Field of Search ..... 297/115, 160, 297/161, 162, 173, 411.35, 411.2, 411.37, 411.38, 411.39

(56) References Cited

U.S. PATENT DOCUMENTS

| | | | | |
|---|---|---|---|---|
| 534,469 | | 2/1895 | Demarest . | |
| 3,174,795 | * | 3/1965 | Chapman et al. | 297/160 |
| 3,353,866 | * | 11/1967 | Chapman et al. | 297/160 |
| 3,479,084 | | 11/1969 | Van Ryn . | |
| 3,547,488 | * | 12/1970 | Barnes | 297/162 |
| 3,556,588 | * | 1/1971 | Monyer et al. | 297/162 |
| 4,944,552 | * | 7/1990 | Harris | 297/162 X |
| 5,087,096 | * | 2/1992 | Yamazaki | 297/162 X |
| 5,683,136 | * | 11/1997 | Baumann et al. | 297/160 X |

* cited by examiner

*Primary Examiner*—Peter M. Cuomo
*Assistant Examiner*—Stephen Vu
(74) *Attorney, Agent, or Firm*—Andrus, Sceales, Starke & Sawall, LLP

(57) ABSTRACT

An assembly for mounting a tablet to the support of a seating assembly includes inner and outer mounting collars which are attached to the tablet support. The inner and outer mounting collars define a passage within which a connecting shaft is supported. The connecting shaft extends from a hinge mechanism connected to the tablet. The connecting shaft includes a radially extending key member. The inner and outer collars form a shaft retaining structure which supports the connecting shaft for pivotal movement and also provides a chamber that accommodates rotation of the key member along an arcuate key path between a front key stop and a rear key stop. This mounting assembly provides two-dimensional rotational movement for the tablet arm, and provides convenient and quiet movement of the tablet arm from a lowered, stored position to a raised, vertical intermediate position and to an operative raised, horizontal position.

24 Claims, 6 Drawing Sheets

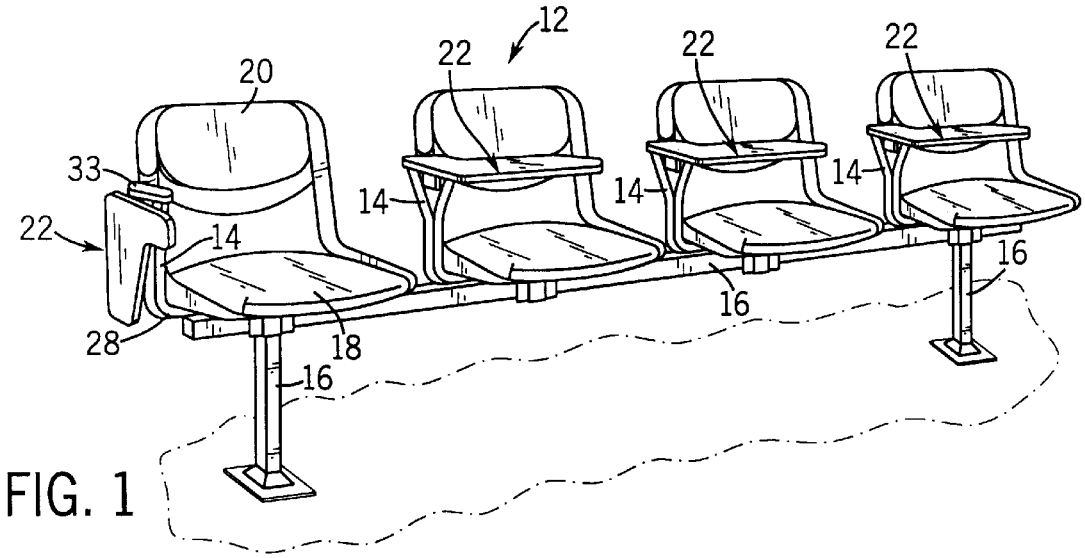
FIG. 1
FIG. 2
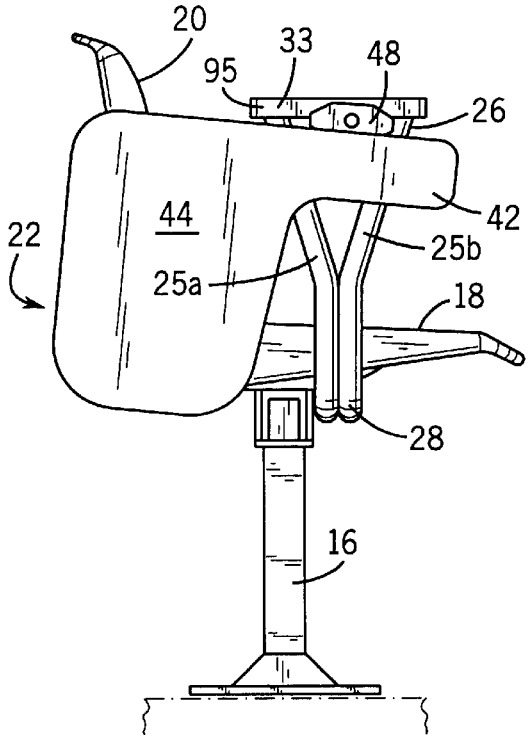

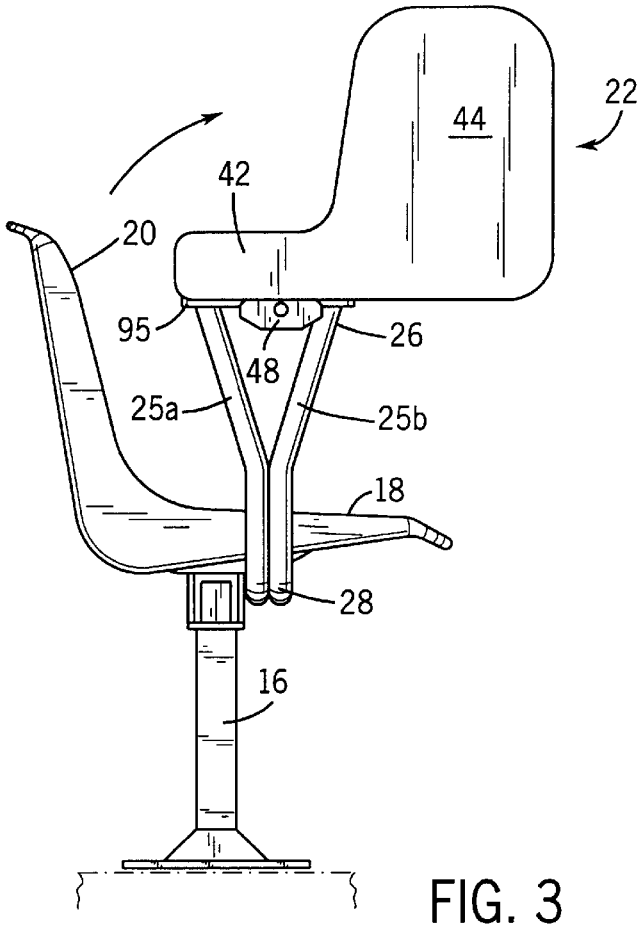
FIG. 3
FIG. 4
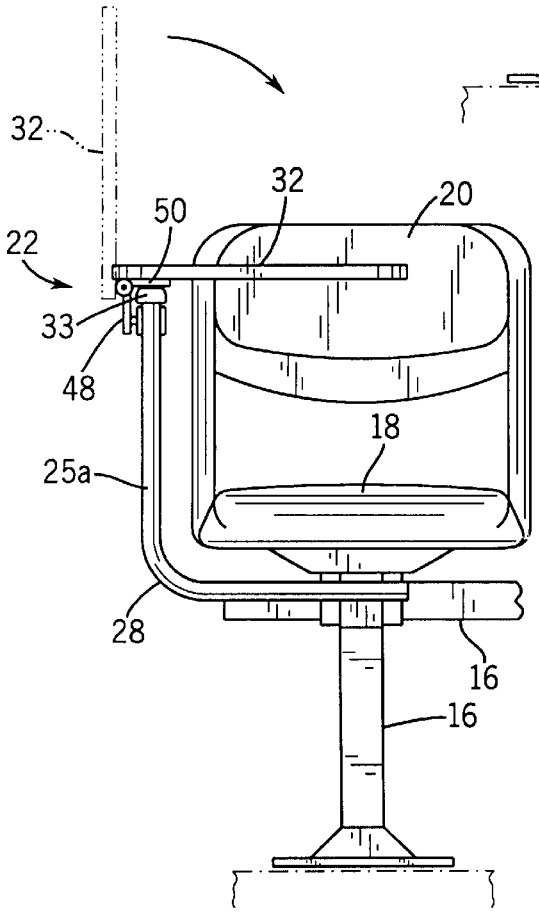

FIG. 9
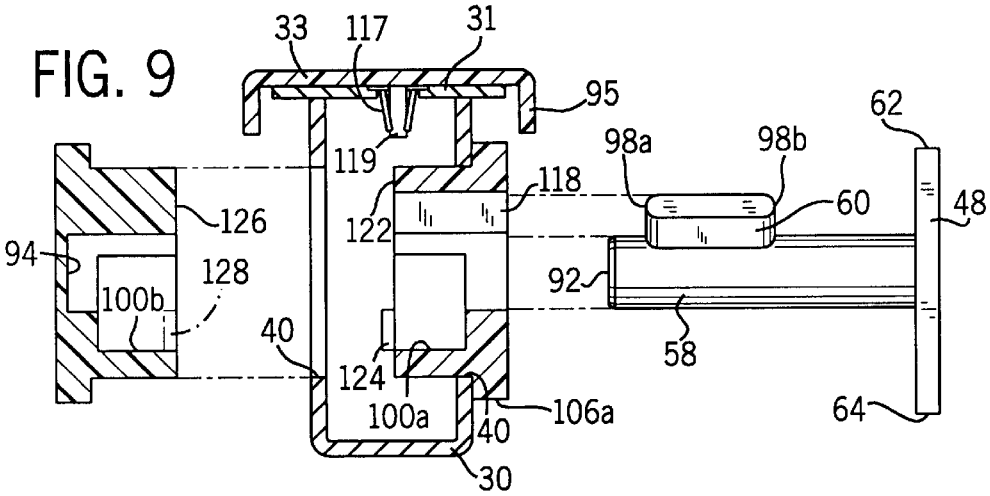
FIG. 10
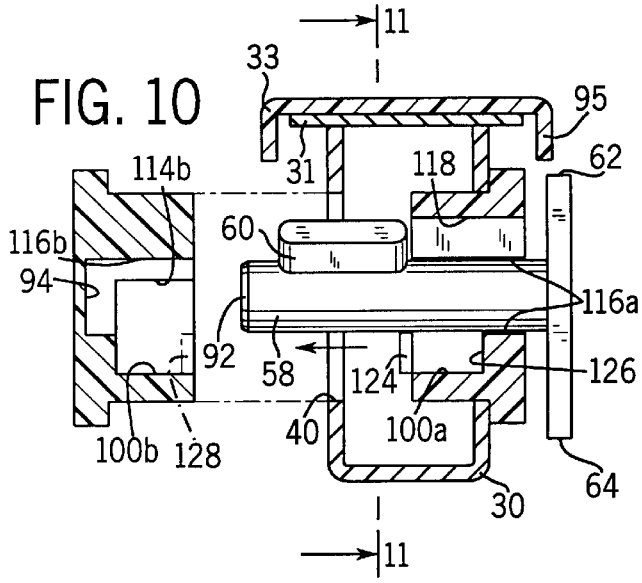
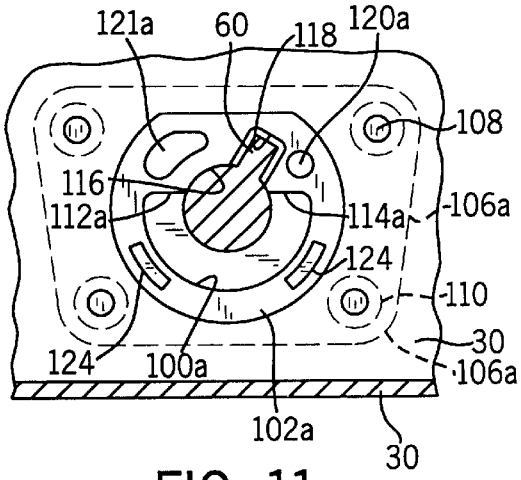
FIG. 11

FIG. 12
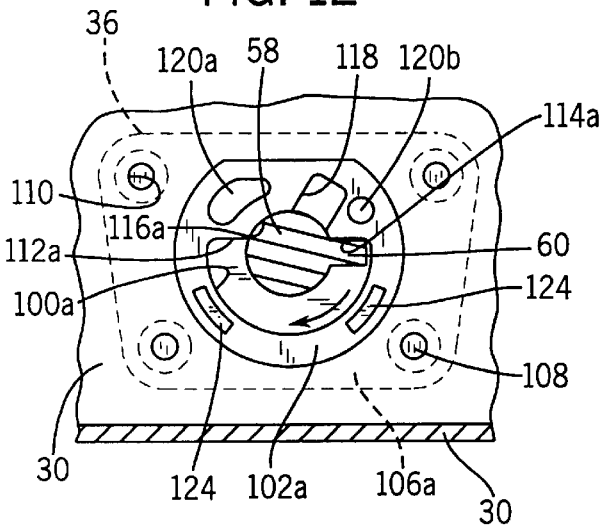
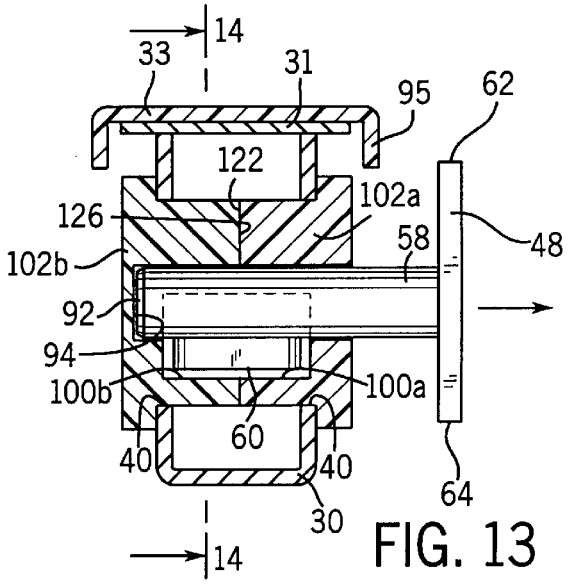
FIG. 13
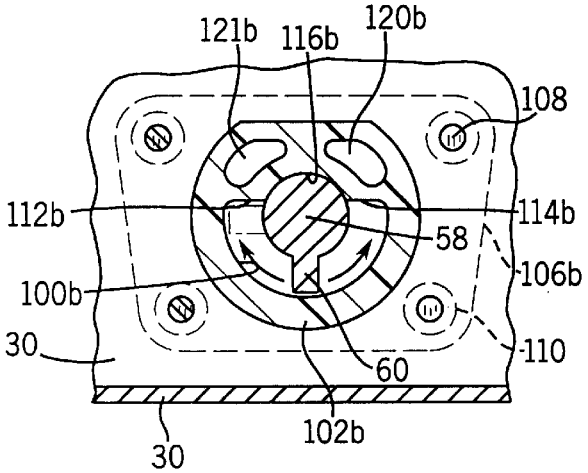
FIG. 14

TABLET MOUNTING ASSEMBLY FOR A SEATING SYSTEM

BACKGROUND AND SUMMARY OF THE INVENTION

This invention relates to a tablet arm assembly for use in combination with a chair or seat, in which the tablet arm assembly is movable between a stored position and an operative position.

In fixed seating systems, it is common to mount a tablet arm to the side support of a seating assembly, such as in an auditorium or educational environment, so as to enable a seated person to take notes or the like. A tablet arm assembly typically includes a chair arm and a planar board or tablet defining an upper writing surface. This tablet is mounted to a movable mounting arrangement providing movement of the tablet relative to the chair arm between an operative position in which the tablet upper surface is substantially horizontal, and a stored position in which the tablet is moved either under the seat or downwardly and beside the side support of the seat.

It is an object of the present invention to provide a tablet mounting assembly for use with a seat or chair. It is another object of the invention to provide a tablet mounting assembly that is relatively simple in construction, and which provides ease of assembly and mounting to the chair arm. It is a further object of the invention to provide a tablet mounting assembly that provides convenient and quiet operation. It is yet another object of the invention to provide a tablet mounting assembly that can be easily repaired in the field.

In accordance with the invention, the tablet mounting assembly is interposed between the tablet and the chair arm. The mounting assembly generally includes a hinge mechanism having a bracket mounted to a bottom surface of the tablet, a connecting shaft mounted to another bracket on the hinge perpendicular to the pivot axis of the hinge, and inner and outer mounting collars secured to the chair arm. The inner and outer mounting collars are aligned to form a shaft retaining structure that is configured to support the connecting shaft for pivotal movement within the collars.

The connecting shaft has a key member that extends radially outward from the shaft. The shaft retaining structure formed by the mounting collar is configured to accommodate rotation of the key member along an arcuate key path between a front key stop and a rear key stop. Preferably, the arcuate key path allows approximately 180° of rotation for the connecting shaft. Hinge rotation is preferably limited to 90° through the use of lugs or some other means. This construction provides the user of the seat with convenient means of moving the tablet arm between an operative position wherein the upper surface of the tablet arm is substantially horizontal, to an intermediate position wherein the tablet arm is rotated about the hinge pivot axis to be substantially vertical, and finally into a storage position wherein the tablet arm is rotated about the shaft pivot axis downwardly and rearwardly to a position adjacent the chair arm next to the side of the seat.

The inner and outer mounting collars are preferably made from injection molded plastic such as nylon. The outer mounting collar has an axial opening extending through the body of the collar from an exposed side of the collar to an inner side of the collar. The outer mounting collar also includes a mounting flange on the exposed side that extends outward from the collar body. The outer mounting collar is preferably secured to the tablet support, such as the chair arm, by fastening the flange to the support with screws or bolts. The connecting shaft passes through the axial opening in the outer collar. An installation slot extends radially from and along the axial opening so that the shaft key member may be inserted through the outer collar for installation. The outer collar also preferably includes a key recess which accommodates rotation of at least a portion of the key member along the arcuate key path. The installation slot in the outer collar extends from the axial opening in a direction away from the arcuate key path. It is most preferable that the installation slot be located closer to the rear key stop than the front key stop because the rear key stop is normally subjected to lower forces than the front key stop when the tablet assembly is in use.

Similar to the outer mounting collar, the inner mounting collar preferably has a mounting flange also on its exposed side for mounting the collar to the tablet support. The inner collar has a recess on its inner side defining a core recessed portion that is aligned with the connecting shaft pivot axis and, also preferably a key recess portion. The core recessed portion pivotally supports the connecting shaft, and the key recess portion accommodates rotation of at least a portion of the key member along the arcuate key path as with the outer collar.

It is most preferable that the outer mounting collar include at least one alignment boss on the surface of its inner side, and that corresponding alignment indentations be located on the surface of the inner side of the inner mounting collar. When the inner and outer mounting collars are secured to the tablet support, the alignment boss resides within the alignment indentation. Further, both the inner and outer mounting collars have a flat portion on the outer circumferential surface of their respective bodies, and mounting plates on the tablet support contain openings having a corresponding geometry. These features aid in ensuring that the collar surfaces defining the shaft retaining structure are properly aligned during installation. Preferably, the inner and outer mounting collars are secured to the tablet support, such that the mounting collars are in axial compression. Under compression, the mounting collars are more effective at withstanding fatigue due to repetitive use. To further reduce problems due to fatigue, the mounting collars preferably contain stress reduction voids located within each respective collar body above the front and rear key stops.

The hinge mechanism of the present invention is generally comprised of a pivot bracket having at least one hinge barrel, a tablet support bracket having at least one hinge barrel, a hinge pin that pivotally connects the pivot bracket hinge barrel to the support bracket hinge barrel, and a connecting shaft with a key member. The tablet support bracket is attached to the bottom surface of the tablet, and the connecting shaft with the key member is attached to the hinge pivot bracket. It is preferred to provide a spring around the hinge pin which is supported by a sleeve, in order to provide a biasing force that cushions the motion of the tablet arm from the substantially vertical intermediate position to the substantially horizontal operative position. For servicing, the pivot bracket also includes access holes that facilitate access to fasteners securing the outer mounting collar to the tablet support.

Preferably, the tablet arm assembly of the present invention includes an arm rest cap covering the top surface of the tablet support which provides a flat and substantially horizontal surface for supporting the tablet support bracket on the bottom surface of the tablet when the tablet is in the substantially horizontal operative position. The arm rest cap is preferably comprised of a plastic material to facilitate quiet operation of the assembly. When the tablet arm is in the stored position, the plastic arm rest cap provides a comfortable arm rest for the user.

The invention also contemplates a particularly effective method of mounting a tablet arm to a seating assembly which uses an inner and outer mounting collar configured substantially in accordance with the foregoing summary. The method and its advantages are discussed in detail below in reference to the drawings. In another aspect of the present invention, an inner mounting collar and an outer mounting collar as explained above are provided as replacement parts for existing tablet arm assemblies.

Various other features, objects and advantages of the invention may be apparent to those skilled in the art upon reviewing the drawings and the following description thereof.

BRIEF DESCRIPTION OF THE DRAWINGS

The drawings illustrate the best mode presently contemplated of carrying out the invention.

In the drawings:

FIG. 1 is a perspective view of a seating assembly comprised of several seats, each having a tablet assembly constructed according to the invention mounted thereto;

FIG. 2 is side elevation of a seat shown in FIG. 1, wherein the tablet is shown in a stored position;

FIG. 3 is a side elevation of the seat assembly shown in FIG. 2, wherein the tablet is rotated into an intermediate position;

FIG. 4 is a front elevational view of the seat shown in FIGS. 2 and 3, wherein the tablet is rotated from the intermediate position to a substantially horizontal operative position;

FIG. 9 is an exploded view showing a first stage of assembly for the tablet mounting assembly;

FIG. 10 is a view similar to FIG. 9 showing a later stage of assembly for the tablet mounting assembly;

FIG. 11 is a view taken along line 11—11 in FIG. 10;

FIG. 12 is a view similar to FIG. 11 showing the key member positioned adjacent the first key stop;

FIG. 13 is a view similar to FIGS. 9 and 10 showing the fully assembled tablet mounting assembly with the key member in a position corresponding to a tablet between the intermediate position of FIG. 3 and the stored position of FIG. 2; and FIG. 14 is a partial section view taken along line 14—14 in FIG. 13.

DETAILED DESCRIPTION OF THE INVENTION

Figure 5:
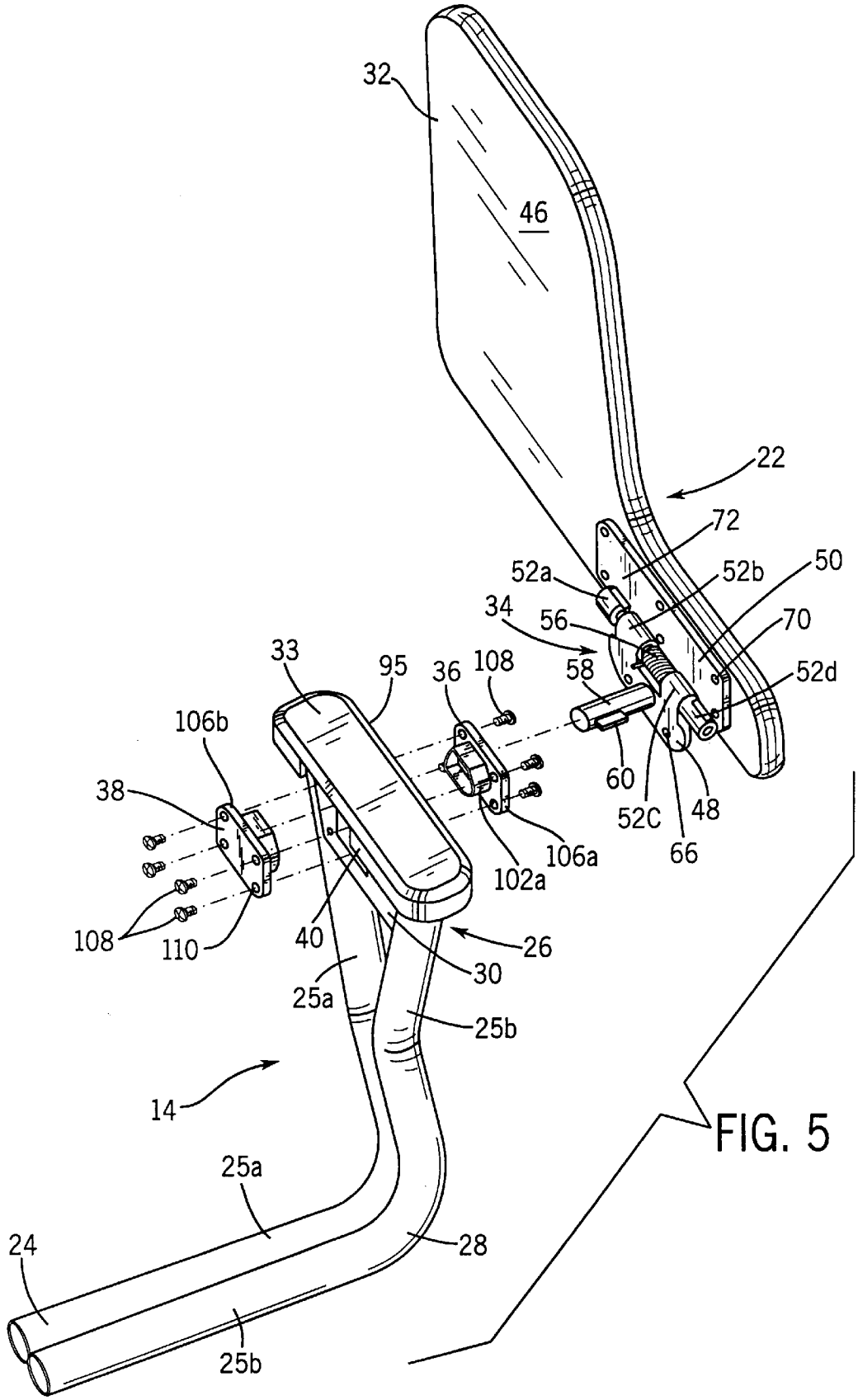
FIG. 5 is a view of a tablet mounting assembly constructed in accordance with the preferred embodiment of the invention.

Referring to FIG. 1, a seating assembly 12 generally includes side supports 14 mounted to a floor mount assembly 16. Seat and back assemblies 18, 20 are mounted adjacent the respective side support assemblies 14. Tablet arm assemblies, shown generally at 22, and constructed according to the present invention, are mounted to the respective side support assemblies 14.

Referring to FIG. 5, side support 14 generally includes two tubular members 25*a*, 25*b* connected together at one end 24, and separated at an opposite end 26. At the opposite end 26, the members 25*a* and 25*b* diverge to form a Y-shape construction. Tubular members 25*a* and 25*b* are bent and mounted in a manner as is known in order to reduce unnecessary stress concentrations. There is a 90° elbow 28 located near the center portion of tubular members 25*a*, 25*b*. Elbow 28 preferably has a radius that mitigates stress concentrations. The side support assembly 14 is capable of supporting relatively substantial loads, such as when a person sits on the tablet arm. It is most preferable that the side support 14 be constructed of steel or another high-strength metal.

A mounting channel 30 (e.g., U-channel) is attached to members 25*a* and 25*b* and spans across the top ends at reference number 26. The purpose of mounting channel 30 is to provide stable and rigid surfaces to mount other elements of the tablet arm assembly 22.

A platform 31 (not shown in FIG. 5, see FIGS. 9, 10, 13) is mounted on top of the tubular members 25*a*, 25*b* and the mounting channel 30. An arm rest cap 33, preferably plastic, is mounted on top of the platform 31. The arm rest cap 33 provides a support surface for a tablet 32 when the tablet 32 is in the substantially horizontal operative position.

Still referring to FIG. 5, the tablet arm assembly 22 generally includes tablet 32, a hinge mechanism 34, a connecting shaft 58 with a key member 60, an outer mounting collar 36, and an inner mounting collar 38. The mounting channel 30 attached to side support 14 has apertures 40 therein to accommodate mounting of the inner and outer mounting collars 36, 38 to the side support 14. The connecting shaft 58 is attached to the hinge mechanism 34 such that it is perpendicular to the pivot axis of the hinge mechanism 34. As is discussed in more detail below, the connecting shaft 58 is mounted within the mounting collars 36 and 38 in such a manner that provides for rotation of the connecting shaft 58 about its longitudinal axis. The combination of pivotal movement about the hinge pivot axis and perpendicular rotation about the longitudinal axis of the connecting shaft 58 provides an elegant system for conveniently positioning the tablet arm 32 between the substantially horizontal operative position (FIG. 4), the substantially vertical intermediate position (FIG. 3) and the substantially vertical stored position (FIG. 2). Though the tablet arm assembly 22 as illustrated in FIG. 5, as well as the other Figures, is designed for use by a right-handed person, similarly constructed left-handed versions of tablet arm assembly 22 are obviously contemplated as falling within the scope of the invention.

Tablet 32 is a quasi-rectangular planar member having an attachment portion 42 extending at approximately 90° from one corner. Conventional materials for constructing the tablet arm 32 consist of wood laminates having a strong, durable top surface 44 (see FIGS. 2, 3 and 5) and a strong, durable bottom surface 46.

Figure 6:
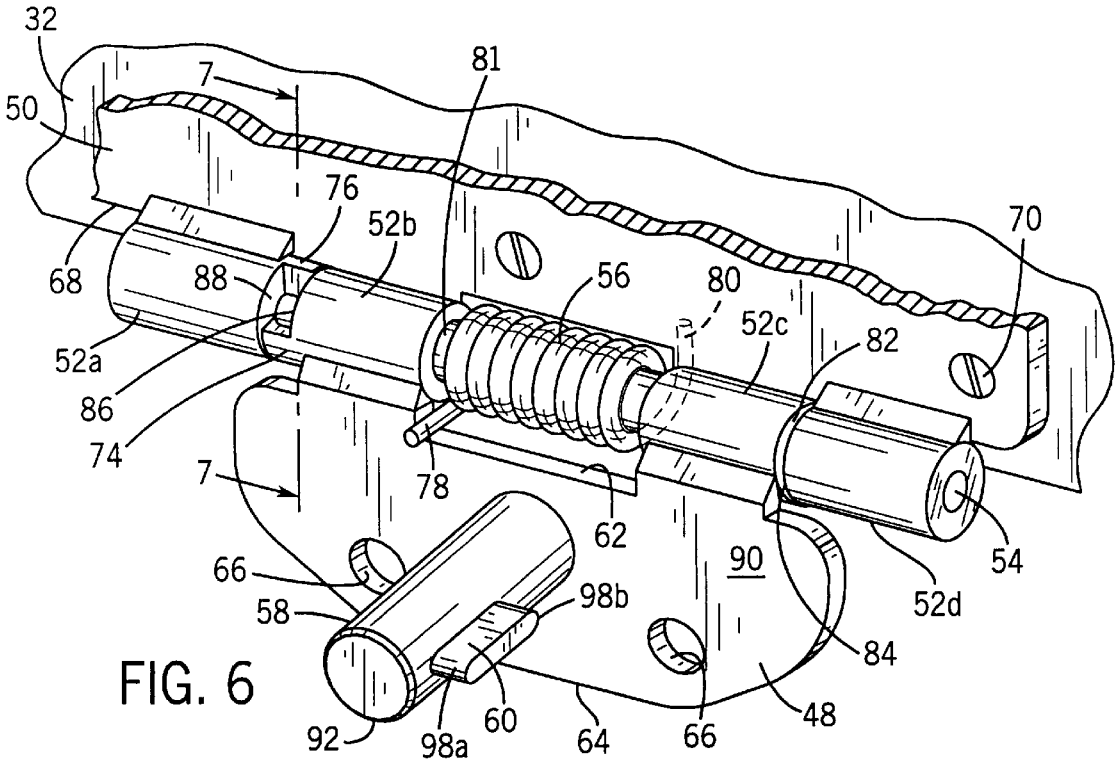
FIG. 6 is a detailed view of a hinge mechanism used in the tablet mounting assembly show in FIG. 5.

FIG. 6 shows the preferred construction of the hinge mechanism 34 and the connecting shaft 58 in detail. Referring to FIGS. 5 and 6, the hinge mechanism 34 includes a pivot bracket 48, tablet support bracket 50, hinge barrels 52*a*–*d*, hinge pin 54 and spring 56. The connecting shaft 58 is mounted to pivot bracket 48 and extends in a direction perpendicular to the pivot axis of the hinge mechanism 34 defined by the hinge pin 54.

Pivot bracket 48 is preferably made from a plate of steel, or the like. Hinge barrels 52*b* and 52*c* (preferably steel) are welded to edge 62 of pivot bracket 48, and their respective axes are aligned so that hinge pin 54 may be placed therethrough. The pivot bracket 48 contains two access holes 66 near the edge 64 of the plate opposite the hinge barrels 52*b* and 52*c*. The access holes 66 facilitate disassembly.

Tablet support bracket 50 is a rectangular plate of steel that is attached to the bottom surface 46 of the tablet 32 using several threaded fasteners 70 (e.g., screws 70). Fasteners 70 are countersunk so that the surface 72 of tablet support bracket 50 is relatively smooth, to enable tablet 32 to rest on the arm rest cap 33 in a stable, substantially horizontal position when tablet 32 is in its horizontal operative position of FIG. 4. Two hinge barrels 52*a* and 52*d* are attached to the edge 68 of tablet support bracket 50 and aligned so that hinge pin 54 can extend therethrough. As with the pivot bracket 48, the hinge barrels 52*a*, 52*d* on the tablet support bracket are preferably welded to the support bracket 50.

Figure 7:
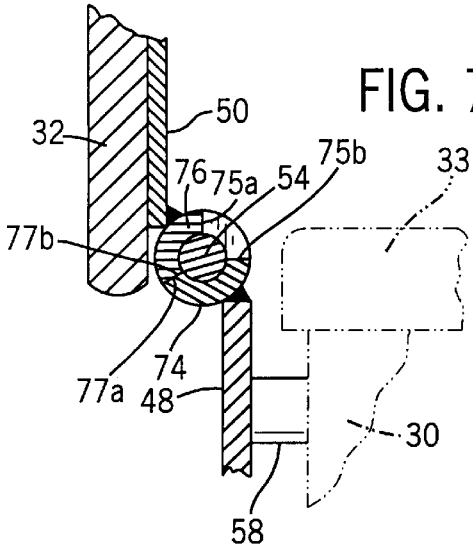
FIG. 7 is a partial section view taken along line 7—7 of FIG. 6, showing the position of hinge lugs when the tablet is in the intermediate position.
Figure 8:
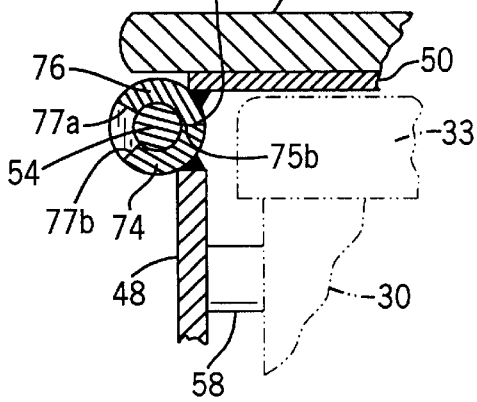
FIG. 8 is a partial section view similar to FIG. 7, showing the position of the hinge lugs when the tablet is in the operative position.

Still referring to FIG. 6, each hinge barrel 52*a*, 52*b*, 52*c*, 52*d* is a hollow cylindrical member. However, hinge barrels 52*a* and 52*b* each have a lug extending therefrom to prevent that tablet arm 32 from over rotating and extending beyond a substantially vertical, intermediate position. Specifically, hinge barrel 52*b* has a lug 74, and hinge barrel 52*a* has mating lug 76. Lugs 74 and 76 can be formed by removing a portion of the hollow cylindrical member. Referring to FIGS. 7 and 8, each lug consists of an arcuate section located between two surfaces (75*a*, 77*a* for lug 76 and 75*b*, 77*b* for lug 74) aligned with a radius of the hinge barrel 52 and spaced approximately 135° apart. Since each lug consists of a 135° arc, rotation about the hinge pivot axis is limited to a 90° range (i.e. the 90° range between substantially horizontal and substantially vertical). Referring specifically to FIG. 7, the surfaces 77*a*, 77*b* on lugs 76 and 74, respectively, are identified herein as intermediate position stop surfaces. The intermediate position stop surfaces 77*a*, 77*b* engage each other in order to prevent over-rotation of the tablet 32 as the tablet 32 is rotated from the substantially horizontal operative position to the substantially vertical intermediate position shown in FIG. 7. Similarly, referring to FIG. 8, the surface 75*a* on lug 76 and the surface 75*b* on lug 74 are identified herein as the operative position stop surfaces. FIG. 8 shows the operative position stop surfaces 75*a*, 75*b* engaging each other when the tablet 32 is positioned in the substantially horizontal operative position. The tablet support bracket 50 engages the arm rest cap 33 when the tablet 32 is placed in the operative position shown in FIG. 8, such that engagement of the operative position stop surfaces 75*a*, 75*b* on the lugs 76, 74 and engagement of table support bracket 50 with arm rest cap 33 provide is not considered to be critical for implementing the invention.

Referring again to FIG. 6, spring 56 is preferably a steel coil spring having sufficient bias to maintain tablet 32 in a vertical position when stored, and to provide limited resistance when moving tablet 32 from the substantially vertical intermediate position to the substantially horizontal operative position. The spring 56 is fully wound with the exception of the ends 78, 80. Each end 78, 80 projects tangentially from the spring coil 56. It is preferable that end 78 project in a direction that is greater than 90° from the direction of end 80 when the spring coil is in its relaxed state. Hinge pin 54 extends through a plastic sleeve 81 located between hinges 52*b* and 52*c*. Sleeve 81 is received within the passage defined by the coil of spring 56, and maintains the radial position of spring 56 relative to hinge pin 54.

Hinge pin 54 is preferably a smooth, cylindrical steel pin, and extends through spring coil 56. The length of the hinge pin 54 is such that it is flush with the outer ends of hinge barrels 52*a*, 52*d*. The hinge pin 54 is preferably held in place by interference within hinge barrels 52*b*, 52*c* on the pivot bracket 48. In a preferred form, a pair of ears are formed from the material of hinge pin 54 at one end of hinge pin 54. The ears are forced into the passage defined by hinge barrel 52*d*, for preventing dislodgment and rotation of hinge pin 54 during operation. Preferably, the hinge mechanism 34 is configured so that the outer edge surface 82 of hinge barrel 52*c* makes sliding contact with the inner edge surface 84 of hinge barrel 52*d*, the inner surface of lug 76 makes sliding contact with outer edge surface 86 of hinge barrel 52*b*, and the outer edge surface of lug 74 makes sliding contact with inner edge surface 88 of lug 52*a*. Light lubrication may be applied between hinge pin 54 and hinge barrels 52*a–d* to prevent corrosion and facilitate pivotal motion.

Still referring to FIG. 6, connecting shaft 58 extends perpendicularly from an inner surface 90 of the pivot bracket 48. Connecting shaft 58 is preferably a cylindrical steel shaft welded to inner surface 90. A distal end 92 of connecting shaft 58 has a beveled edge to prevent nicking of the inner and outer mounting collars 36, 38 during assembly. Referring to FIG. 13, the length of connecting shaft 58 is such that it fits within inner mounting collar 38 without touching the vertical portion of the interior surface of the mounting collar identified by reference number 94 in FIG. 6, although the shaft 58 preferably extends slightly beyond the mounting channel 30.

Key member 60 extends radially outward from the surface of the connecting shaft 58. The key member 60 is preferably in the shape of an elongated rectangle when viewed from the side (see FIG. 13), and preferably has a cross-section defining parallel sides and rounded ends, shown at 98*a*, 98*b* (FIG. 9) which prevent key member 60 from nicking the interior surfaces of inner and outer mounting collar 36, 38 during assembly or operation. The key member 60 is made of a material, such as hardened steel, that is sufficiently strong to withstand the shear forces experienced in operation. The key member 60 is press fit and secured with an adhesive into a slot formed in the side surface of shaft 58. Other means of mounting key member 60 may be employed, such as welding or forming key member 60 integrally with shaft 58. As shown in FIG. 13, the size and placement of key member 60 on connecting shaft 58 is such that it fits within the surfaces defining a key chamber and an arcuate key path 100 within the collars 36, 38, without rubbing or sliding against the surfaces.

Referring to FIGS. 5 and 12, outer and inner mounting collars 36, 38 each have a collar body 102*a*, 102*b* designed to fit within apertures 40 in mounting channel 30. As seen in FIG. 12, aperture 40 is generally circular with a flat portion 104 to locate collars 36, 38 during assembly and to prevent collars 36, 38 from rotating. Each collar body 102*a*, 102*b* has a mounting flange 106*a*, 106*b* on the respective exposed side of the collar 36, 38 for the purpose of securing the outer and inner mounting collars 36, 38 to mounting channel 30. The mounting flanges 106*a*, 106*b* are secured to mounting channel 30 using threaded fasteners 108, such as screws or bolts. Openings 110 are formed in the flanges 106*a*, 106*b* to accommodate fasteners 108. As previously mentioned, the inner mounting collars 36, 38 are preferably made from injection molded plastic and most preferably nylon. This material presents the advantages of quiet operation, durability, and relatively low-cost production.

Referring now to FIGS. 10–13, outer and inner mounting collars 36, 38 form a shaft retaining structure defined generally by surfaces 100*a*, 100*b*, 112*a*, 112*b*, 114*a*, 114*b*, 116*a*, 116*b* and 94. The interior structure of outer mounting collar 36 is defined by surfaces 100*a*, 112*a*, 114*a*, 116*a* and 118. Surface 100*a* defines a volume wherein key member 60 resides. Surface 116*a* defines an axial opening that supports the connecting shaft 58 for rotation about the longitudinal axis of the shaft 58. As shown in FIG. 12, key member 60 rotates within the arcuate key path defined by surface 100*a* between a front key stop defined by surface 114*a* and a rear key stop defined by surface 112*a*. As shown in the drawings (e.g., FIG. 12), the key member 60 rotates approximately 180° within the arcuate key path defined by the surface 100*a*. Preferably, the front key stop 112*a* and the rear key stop 114*a* are located generally in the same horizontal plane. In order to accommodate the width of the key 60, it is preferred that the horizontal plane passing through the front key stop 112*a* and the rear key stop 114*a* be located above the pivot axis defined by the connecting shaft 58. Surface 116*a* is generally a cylindrical aperture interrupted in part by surface 100*a*, and interrupted along its entire length by surface 118 defining an installation slot. As shown in FIG. 11, there are a pair of voids 120*a*, 121*a* extending through outer mounting collar 36 to flange 106*a*, which allow the material located directly adjacent surfaces 112*a* and 114*b* to flex when engaged by key member 60.

Surface 100*a* defining the arcuate key path and surface 118 defining the installation slot are configured to maintain a slight clearance from key member 60. The diameter of the surface 116*a* defining the axial opening that supports the connecting shaft 58 is selected to provide a sliding fit between outer mounting collar 36 and connecting shaft 58 without any clearance.

As shown in FIG. 9, a platform 31 is secured at the open end of the mounting channel 30 such as by welding, to provide a flat, stable surface for the arm rest cap 33. A pair of one-way Tinnerman-type fastener clips 117 are mounted to platform 31 in alignment with openings formed in platform 31. Arm rest cap 33 is formed with a pair of bosses 119. Arm rest cap 33 is positioned such that each boss 119 is aligned with one of clips 117, and is pounded onto platform 31 such that each clip 117 engages one of bosses 119 to securely mount arm rest cap 33 to platform 31. It is understood, however, that other mounting methods may be employed for securing arm rest cap 33 to platform 31. Preferably, platform 31 is fully covered by the cap 33. Cap 33 serves as an arm rest when tablet 32 is stowed, and engages tablet support bracket 50 on the bottom surface 46 of the tablet 32 when the tablet 32 is in the operative position. Preferably, cap 33 is made of a plastic material to provide quiet engagement with metal support bracket 50. Cap 33 preferably has beveled or rounded edges and depending flanges 95.

Still referring to FIG. 9, inner mounting collar 38 has an interior structure defined by surfaces 94, 100*b*, 114*b* and 116*b*. Surfaces 116*b* and 94 together form the core recess portion. Surface 116*b* of the core recess forms a continuation of the axial opening that supports the connecting shaft 58 and preferably has the same diameter as surface 116*a*. Surface 100*b* forms a recess portion and is sized to accommodate key member 60 rotation with clearance between the key member 60 and the surface 1000*b*. As shown in FIG. 14, inner mounting collar 38 includes voids 120*b*, 121*b*. Voids 120*b*, 121*b* serve the same purpose as voids 120*a*, 121*a* in that they aid in preventing plastic deformation of key stop surfaces 112*b* and 114*b*.

Extending from an inner mating surface 122 of the outer mounting collar 36 is a pair of alignment bosses 124 (see FIGS. 9 and 11). Alignment bosses 124 correspond with alignment indentations 128 formed on a mating inner surface 126 of inner mounting collar 38. The purpose of the alignment bosses 124 and alignment indentations 128 is to facilitate the alignment of the inner and outer mounting collars 38, 36 during installation. Referring now to FIG. 13, outer and inner mounting collars 36, 38 contact each other at inner mating surfaces 122, 126, respectively. Most preferably, when the outer and inner mounting collars 36, 38 are secured to the mounting channel 30, collar bodies 102*a* and 102*b* are under compression. Surfaces 112*a*, 112*b*, 114*a*, 114*b*, 116*a*, 116*b*, and 100*a*, 100*b* are aligned so that key member 60 contacts the surfaces defining each key stop 112*a*, 112*b* and 114*a*, 114*b* simultaneously. The alignment bosses 124 and indentations described above ensure proper alignment.

The installation of tablet arm assembly 22 is now explained with reference to FIGS. 9–13. First, outer mounting collar 36 is securely attached to mounting channel 30 using fasteners 108, preferably threaded fasteners 108 such as stainless steel screws. Next, the tablet arm assembly 22 is presented, and positioned so that key member 60 is aligned with the installation slot defined by surface 118 (see FIG. 9). Connecting shaft 58 is inserted through and beyond the installation slot defined by surface 118 (see FIG. 10). Once the key member 60 clears the installation slot defined by surface 118, the tablet arm assembly 22 is turned so that the key member 60 rotates downwardly towards the surface 100*a* defining the arcuate key path. Next, the tablet arm assembly 22 is pulled back towards the installer so that key member 60 temporarily makes contact with inside surface 126 (FIG. 10) of the outer mounting collar 36. Then, inner mounting collar 38 is aligned with connecting shaft 58 and alignment boss 124 on outer mounting collar 36. The inner mounting collar 36 is secured to mounting channel 30 with fasteners 108. Arm rest cap 33 is then pounded on to platform 31 such that mounting bosses 119 engage clips 117.

If mounting collars 36, 38 need repair and/or replacement, the following reinstallation procedure is effective. First, fasteners 108 are removed from the outer mounting collar 36. Access is provided to the fasteners 108 either by rotating pivot bracket 48 so that access hole 66*a* or 66*b* are aligned with the respective fastener 108, or by rotating the bracket 48 completely away to otherwise provide access to the respective fastener. Next, tablet arm assembly 22 is pulled away from support 30 along with the unfastened outer mounting collar 36. The inner mounting collar 38 is then removed. To reinstall new or repaired mounting collars 36, 38, the above-described installation procedure is used.

It should be apparent to those skilled in the art that the mounting assembly of the present invention provides an assembly that is quick and easy to install on the seat support, either during original manufacture, as a retrofit, or for servicing.

Various alternatives and embodiments are contemplated as being within the scope of the following claims which particularly point out and distinctly claim the subject matter regarded as the invention.

I claim:

1. A tablet assembly for use with a seating arrangement having at least one seat and a tablet support located adjacent a side of the seat, the tablet assembly comprising a tablet and a tablet mounting assembly interposed between the tablet and the tablet support, wherein the tablet mounting assembly includes:

a hinge mechanism having a tablet support member and a pivot member pivotably connected to the tablet support member along a hinge pivot axis, the tablet support member being mounted to a bottom surface of the tablet;

a pivot shaft mounted to and extending from the pivot member of the hinge mechanism, the pivot shaft having a key member extending radially outward therefrom; and an inner mounting collar and an outer mounting collar secured to each other and to the tablet support, wherein the inner and outer mounting collars include a shaft retaining structure defining an axial passage and an opening through which the pivot shaft extends into the passage, said shaft retaining structure also including a recess defining an arcuate key path located between a front key stop and a rear key stop, wherein the pivot shaft is pivotally movable within the passage of the shaft retaining structure and the key member is received within the recess and movable within the arcuate key path between the front key stop and the rear key stop;

wherein the tablet mounting assembly provides pivotal movement of the tablet between an operative position in which an upper surface of the tablet is substantially horizontal, and an intermediate position in which the tablet is rotated about the hinge pivot axis to be non-horizontal, and a storage position in which the tablet is rotated about a pivot axis defined by the pivot shaft downwardly and rearwardly from the intermediate position to a location adjacent the tablet support.

2. The tablet assembly of claim 1 wherein:

the outer mounting collar has an exposed side and an inner side, and wherein the opening extends inwardly from the exposed side and receives the pivot shaft; and the outer mounting collar further includes an installation slot extending radially from the opening in a direction away from the recess defining the arcuate key path, said installation slot being adapted to receive the key member on the pivot shaft during installation.

3. The tablet assembly of claim 2 wherein the installation slot is formed in the outer mounting collar at a location spaced from the recess, between the rear key stop and the front key stop.

4. The tablet assembly of claim 1 wherein the outer mounting collar includes a collar body, a mounting flange which defines an exposed side of the collar, an axial opening extending inwardly from the exposed side of the collar to receive the pivot shaft, and wherein the shaft retaining structure of the outer mounting collar includes an arcuate key recess in communication with the opening and located on an inner side of the outer mounting collar, wherein the arcuate key recess extends between the front key stop and the rear key stop.

5. The tablet assembly of claim 1 wherein the inner mounting collar and the outer mounting collar each contain stress reduction voids adjacent the front and rear key stops of the shaft retaining structure.

6. The tablet assembly of claim 1 wherein the inner mounting collar defines an exposed side and an inner side, and wherein the shaft retaining structure of the inner mounting collar includes a recess formed in the inner side, said recess including a core recess portion aligned with the shaft pivot axis and sized to receive an end of the pivot shaft for pivotally supporting the pivot shaft, and a key recess portion in communication with the core recess portion, wherein the key recess portion receives at least part of the key member and accommodates rotation of the key member along the arcuate key path between the front key stop and the rear key stop.

7. The tablet assembly of claim 1 further including at least one alignment boss on a surface of one of the inner and outer mounting collars, and a corresponding alignment indentation on a facing surface of the other of the inner and outer mounting collars, wherein the alignment boss is received within the alignment indentation when the inner and outer mounting collars are secured to the tablet support.

8. The tablet assembly of claim 1 wherein the front key stop and the rear key stop are substantially coplanar and horizontal, and are located vertically above the shaft pivot axis.

9. The tablet assembly of claim 1 wherein the inner mounting collar and outer mounting collar are made from injection molded nylon.

10. The tablet assembly of claim 9 wherein the inner and outer mounting collars are in axial compression with each other when secured to the tablet support.

11. The tablet assembly of claim 1 wherein the inner and outer mounting collar each include a non-circular body engaged with a mating non-circular opening formed in the tablet support to prevent rotation of the respective collar when the inner and outer mounting collars are secured to the tablet support.

12. The tablet assembly of claim 1 wherein the pivot member of the hinge mechanism has at least one hinge barrel, and the tablet support member of the hinge mechanism has at least one hinge barrel and wherein the hinge mechanism further comprises a hinge pin engaged with and pivotally connecting the pivot member hinge barrel and tablet support member hinge barrel, and a spring engaged between the pivot bracket and the tablet support bracket for providing a biasing force therebetween.

13. The tablet assembly of claim 12 wherein the pivot member hinge barrel has a lug at one end which defines an intermediate position stop surface, and wherein the tablet support member hinge barrel has a mating lug at one end which defines an intermediate position stop surface, and wherein the intermediate position stop surfaces of the lugs engage each other to orient the tablet arm in a substantially vertical position when the tablet arm is pivoted from the operative position to the intermediate position.

14. The tablet assembly of claim 13 wherein each of the lugs extends from a hollow cylinder defining the hinge barrel, and wherein each of the lugs extends between an operative position stop surface and the intermediate position stop surface.

15. The tablet assembly of claim 1 wherein the pivot member of the hinge mechanism has one or more access holes which are adapted for placement into alignment with one or more fasteners which secure the outer mounting collar to the tablet support.

16. The tablet assembly of claim 1 further including an arm rest having a top surface that engages the tablet support member when the tablet arm is in the operative position.

17. A two-part mounting assembly for use in mounting a tablet to a seating arrangement, said mounting assembly comprising:

an inner mounting collar having an inner side, an exposed side, and a mounting flange on the exposed side; and an outer mounting member having an inner side, an exposed side, and a mounting flange on the exposed side;

wherein the inner mounting member and the outer mounting member are adapted to be received within openings defined by the seating arrangement and secured to each other and to the seating arrangement, wherein the inner and outer mounting members cooperate to define a recess within which a pivot shaft of the tablet assembly is received, to movably mount a tablet to the seating arrangement for movement between a raised, operative position and a lowered, storage position.

18. The mounting assembly of claim 17 wherein the tablet is interconnected with a pivot shaft having a key extending therefrom, and wherein the outer mounting member further includes an installation slot extending radially from an axial opening in a direction away from an arcuate key recess defined by each of the inner and outer mounting members, said installation slot being sized to accommodate the key on the pivot shaft during installation.

19. The mounting assembly of claim 17 wherein the inner mounting member includes a recess having a core recess portion which receives and supports the pivot shaft and a key recess portion which receives and accommodates rotation of the key.

20. The mounting assembly of claim 19 wherein the core recess portion comprises a cylindrical passage.

21. The mounting assembly of claim 17 wherein the inner side of the outer mounting member has an alignment boss extending therefrom, and the inner side of the inner mounting member has a corresponding alignment indentation, wherein the alignment boss is received within the alignment indentation to align the inner and outer mounting members.

22. A tablet mounting assembly for movably mounting a tablet to a seat assembly having a tablet support, said assembly comprising:

a hinge assembly adapted for engagement with the tablet and defining a first pivot axis;

a mounting arrangement adapted for mounting to the tablet support, wherein the mounting arrangement includes a passage and a recess;

a pivot arrangement interposed between the mounting arrangement and the hinge assembly, wherein the pivot arrangement includes a pivot shaft and a key member extending radially from the pivot shaft, wherein the pivot shaft is pivotally received within the passage of the mounting arrangement and defines a second pivot axis non-parallel to the first pivot axis, and wherein the key member is received within the recess of the mounting arrangement; and wherein the mounting arrangement includes stop structure engageable by the key member to define a range of pivoting movements of the hinge assembly relative to the mounting arrangement;

wherein the tablet is pivotable about the first pivot axis between a lowered operative position and a raised intermediate position, and is pivotable about the second pivot axis between the raised intermediate position and a lowered storage position.

23. The tablet mounting assembly of claim 22, wherein the stop structure comprises a pair of spaced stop surfaces within the recess and engageable by the key member for controlling the range of movements of the pivot shaft relative to the mounting arrangement.

24. The tablet mounting assembly of claim 23, wherein the mounting arrangement comprises a pair of mounting members, wherein the mounting members include a structure defining the passage, the recess and the stop surfaces, and wherein each of the mounting members is adapted for mounting to one of a pair of opposed mounting areas defined by the tablet support, wherein the mounting members are engaged with each other and with the tablet support for securing the tablet mounting assembly to the seat assembly.

* * * * *

UNITED STATES PATENT AND TRADEMARK OFFICE

CERTIFICATE OF CORRECTION

PATENT NO. : 6,224,149 B1
DATED : May 1, 2001
INVENTOR(S) : Steven C. Gevaert

It is certified that error appears in the above-identified patent and that said Letters Patent is hereby corrected as shown below:

Column 10,
Line 22, delete "9" and substitute therefore -- 1 --.

Signed and Sealed this

Eighteenth Day of February, 2003

JAMES E. ROGAN
*Director of the United States Patent and Trademark Office*